US005370262A

United States Patent [19]

Kato

[11] Patent Number: 5,370,262

[45] Date of Patent: Dec. 6, 1994

[54] SPOUT RESISTING LID FOR A DRINK CONTAINER

[76] Inventor: Kazuhiko Kato, 115, Ouazashimoichibu, Sasagamimura, Kitakanbaragun, Niigataken, Japan

[21] Appl. No.: 150,620

[22] Filed: Nov. 10, 1993

[30] Foreign Application Priority Data

Jul. 27, 1993 [JP] Japan ..... 5-185194

[51] Int. Cl.[5] ..... A47G 19/22

[52] U.S. Cl. ..... 220/731; 220/269; 222/189

[58] Field of Search ..... 220/269, 270, 271, 272, 220/273, 694, 713, 729, 731; 222/189, 478, 481, 482, 484, 541, 565; 40/306, 307

[56] References Cited

U.S. PATENT DOCUMENTS 4,537,326 8/1985 Morehead ..... 220/269

FOREIGN PATENT DOCUMENTS 57-55143 11/1982 Japan .

58-33447 3/1983 Japan .

*Primary Examiner*—Allan N. Shoap

*Assistant Examiner*—Nova Stucker

*Attorney, Agent, or Firm*—Quarles & Brady

[57] ABSTRACT

A container for liquid with an auxiliary lid which is capable of preventing a large quantity of bubbles and liquid within the container from spouting out. The auxiliary lid body is provided a distance above an opening-lid which is opened by lifting a tab provided on the lid of the container. Air holes are provided in the auxiliary lid body whereby, upon opening the container, spouting of beer or soda or other liquid contents stops and remains within a space surrounded by the auxiliary lid and container lid. As a result, bubbles and liquid are prevented from dispersing. A protrusion for opening the container also enables the auxiliary lid to be secured without rattling.

18 Claims, 7 Drawing Sheets

SPOUT RESISTING LID FOR A DRINK CONTAINER

BACKGROUND OF THE INVENTION (a) Field of the Invention

The present invention relates to an auxiliary lid of a beer canor a soda-pop can or the like to which tabs are attached.

(b) Description of Prior Art

A container of which the lid is able to be easily opened has already been obvious to those skilled in the art, which is for example disclosed in Japanese patent publication No. 57-55143, in which a part of the lid is cut off by picking up a part of the lid. However, recently, is widely used a can lid such that a lid is cut off to be pushed into the container by the lever action of picking up a tab attached thereto. However, such conventional art as mentioned above have had such a problem that a large quantity of bubbles or liquid included in the container often would spout out to stain the surroundings. To close such an opened lid, Japanese Utility Model laid-open No. 58-33447 discloses a sealing plug for a can, in which an absorption member is provided within the cap fitted into upper edge of a can. However, the disclosed sealing plug for a can cannot be utilized in opening a can.

SUMMARY OF THE INVENTION

Accordingly, it is the main object of the present invention to provide an auxiliary lid of a container with a tab which can prevent a great deal of bubbles and liquid from spouting out of the container in opening a part of the container lid by picking up the tab attached to the lid.

It is another object of the present invention to provide an auxiliary lid of a container with a tab which can prevent a great deal of bubbles and liquid from spouting out of the container without backlash or unsteadiness of the auxiliary lid while opening a part of the lid by picking up the tab integrated therewith.

In accordance with a major feature of the present invention, there is provided a structure for an auxiliary lid of a container with a tab comprising: an auxiliary lid body removably and spacedly covering an opening-lid portion formed in the container lid which is opened by picking up a tab attached thereto; a plurality of air holes provided in said auxiliary lid.

BRIEF DESCRIPTION OF THE DRAWINGS

Other objects, features and advantages of the invention will be apparent to those skilled in the art from the following description of the preferred embodiment of the invention, wherein reference is made to the accompanying drawings, of which.

DESCRIPTION OF A PREFERRED EMBODIMENT

Hereinafter is described a first embodiment of the present invention with reference to FIGS. 1 to 7.

Figure 1:
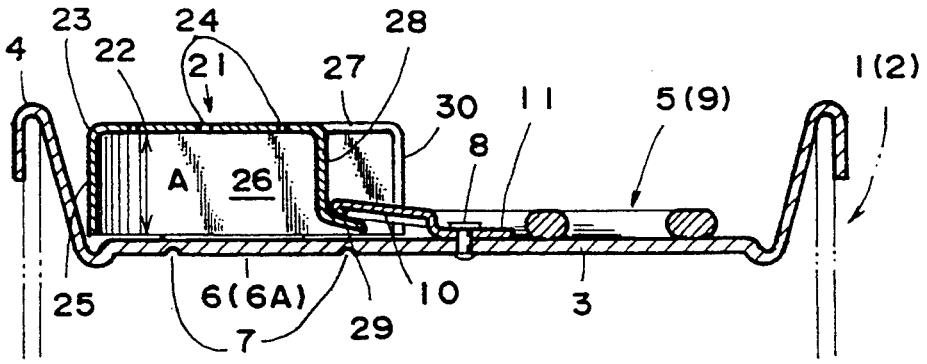
FIG. 1 is a longitudinal section showing a mounted auxiliary lid of the first embodiment of the present invention.
Figure 2:
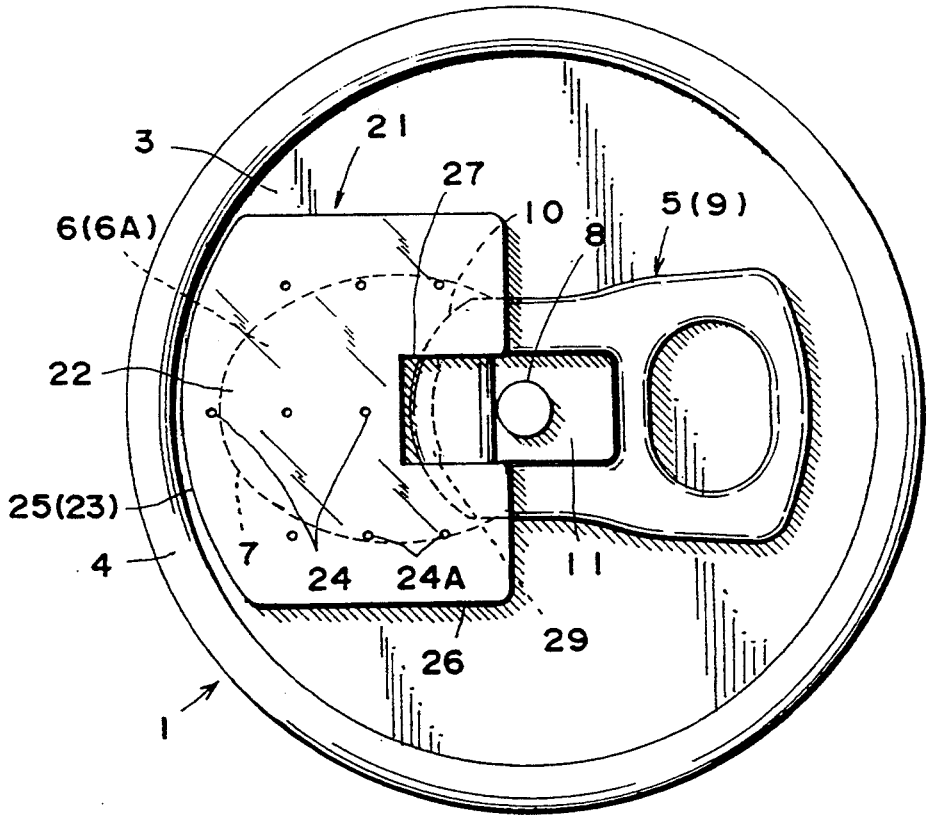
FIG. 2 is a plan view showing a mounted auxiliary lid of the first embodiment of the present invention.
Figure 3:
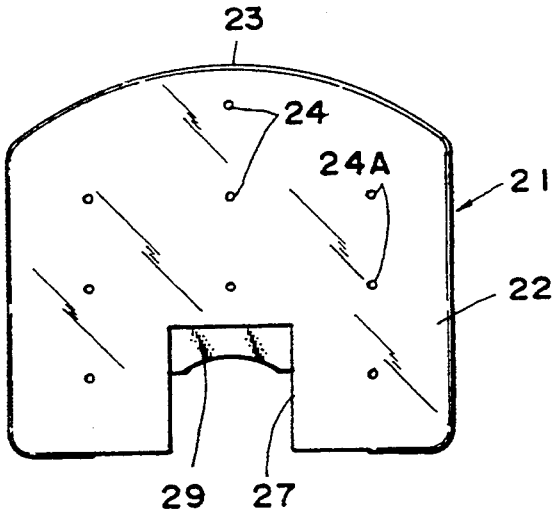
FIG. 3 is also a plan view showing an auxiliary lid of the first embodiment of the invention.
Figure 4:
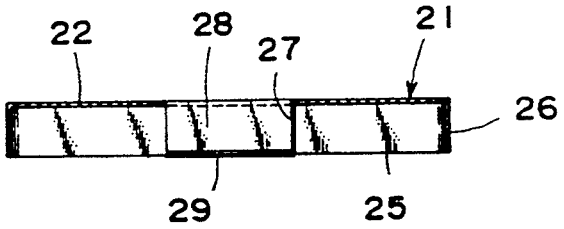
FIG. 4 is a front section showing an auxiliary lid of the first embodiment of the invention.
Figure 5:
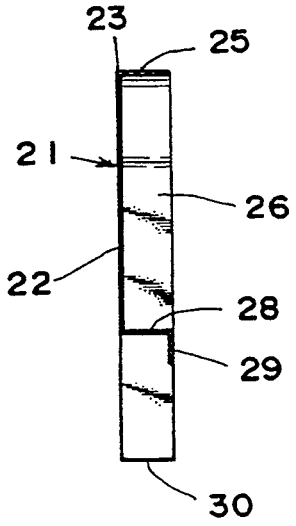
FIG. 5 is a side section showing an auxiliary lid of the first embodiment of the invention.
Figure 6:
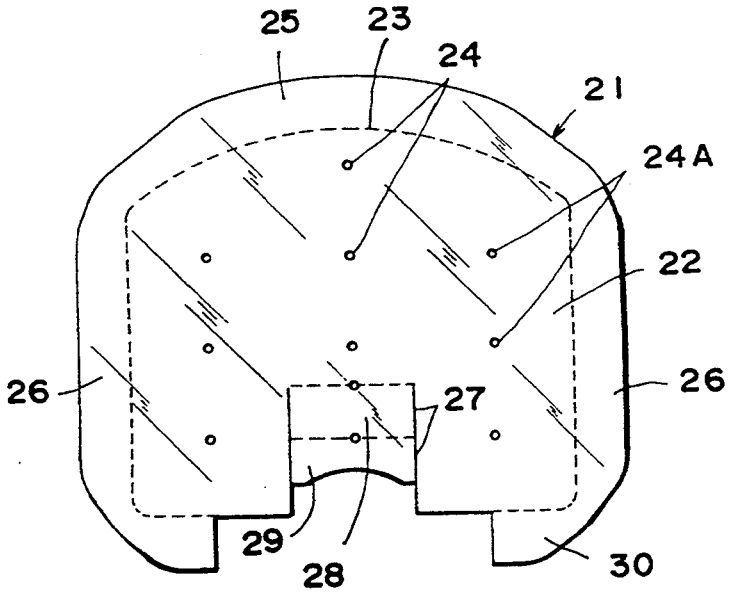
FIG. 6 is a development showing an auxiliary lid of the first embodiment of the present invention.
Figure 7:
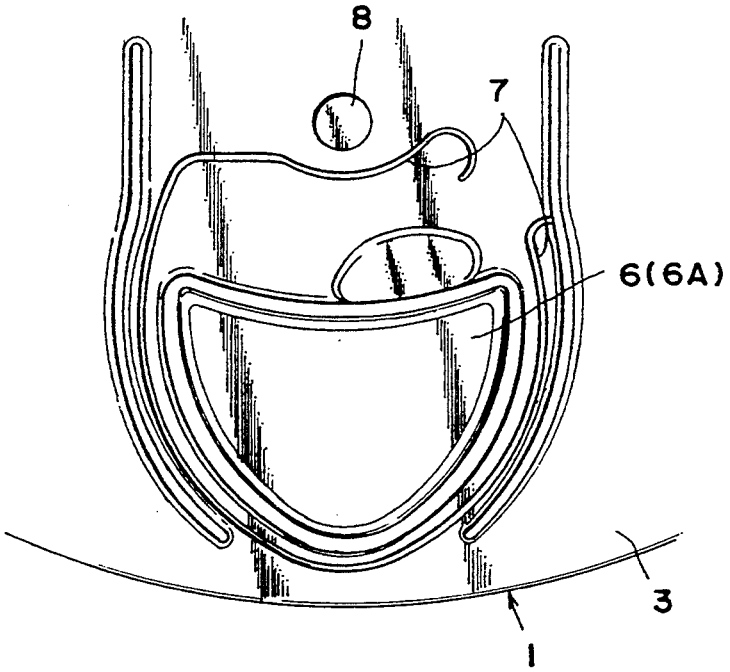
FIG. 7 is a bottom view showing a container lid of the first embodiment of the present invention.
Figure 8:
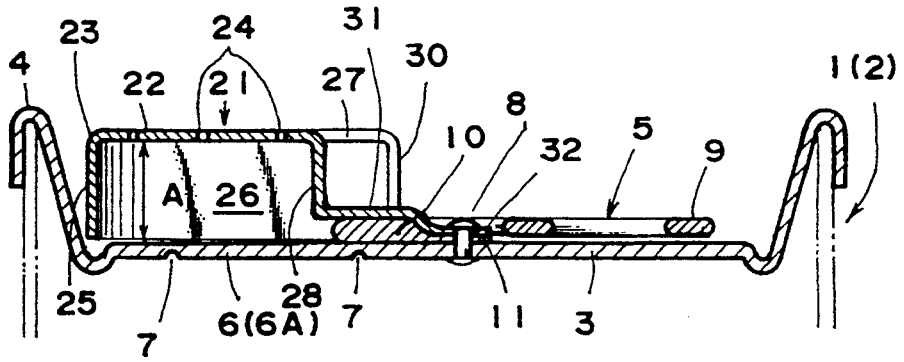
FIG. 8 is a longitudinal section showing a mounted auxiliary lid of the second embodiment of the present invention.
Figure 9:
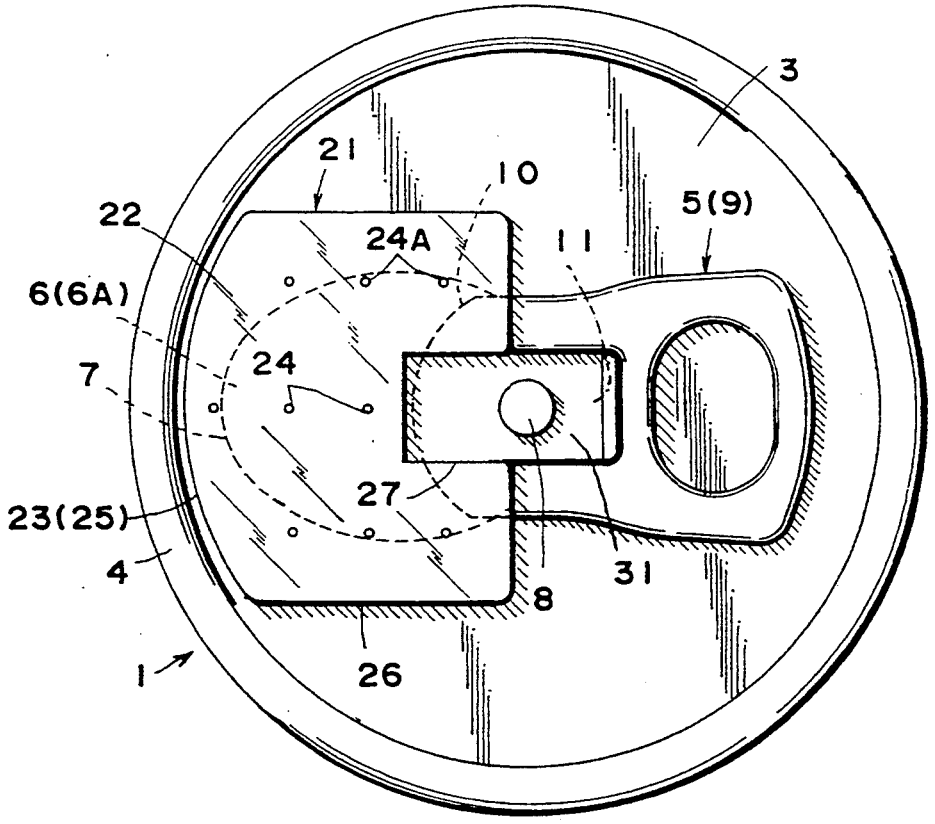
FIG. 9 is a plan view showing a mounted auxiliary lid of the second embodiment of the present invention.
Figure 10:
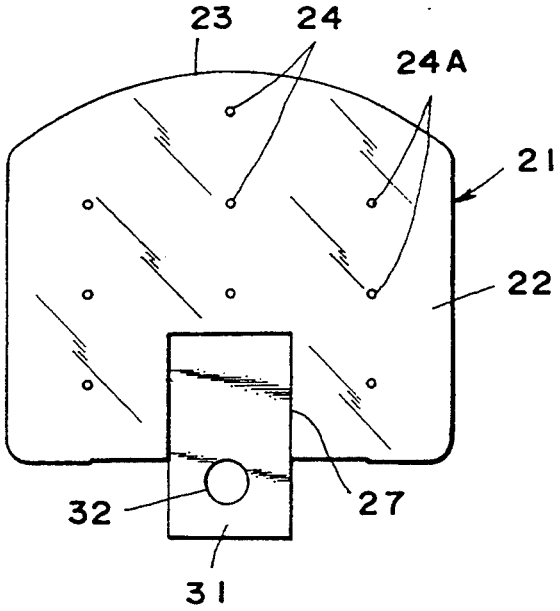
FIG. 10 is also a plan view showing an auxiliary lid of the second embodiment of the present invention.
Figure 11:
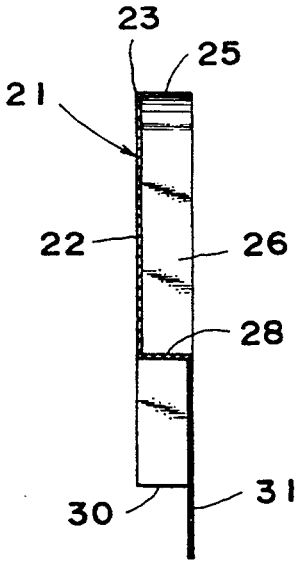
FIG. 11 is a side section showing an auxiliary lid of the second embodiment of the present invention.
Figure 12:
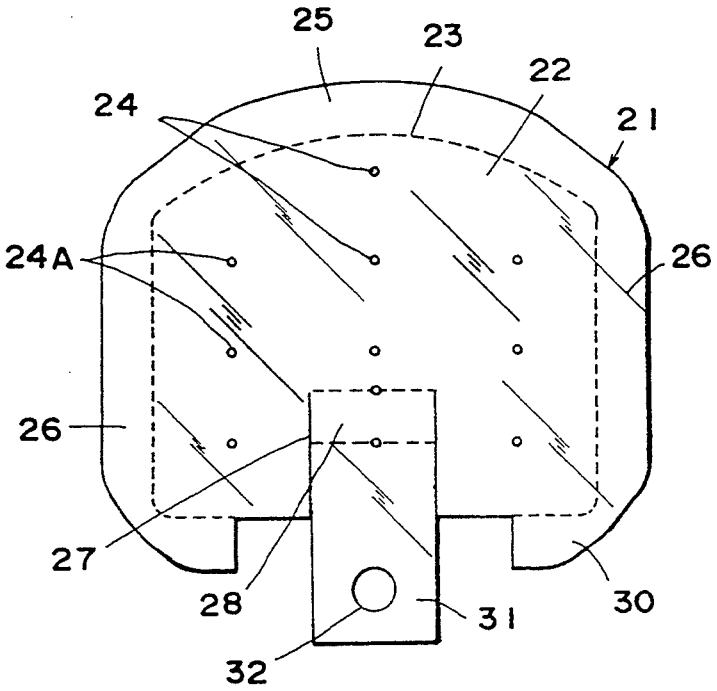
FIG. 12 is a development showing an auxiliary lid of the second embodiment of the present invention.

As shown in FIG. 1, a can or a container 1 made of aluminum, steel or the like is formed by attaching a lid 3 to a cylindrical portion 2. Here the reference numeral 4 designates an errected edge provided in the peripheral edge of said lid 3. On said lid 3 is provided a tab 5 to open a part of said lid 3. On one side of the upper surface and bottom surface of said lid 3 is provided an opening-lid 6 of approximately an elliptical configuration, around which is provided approximately an annual groove 7. To the central side of said opening-lid 6 is secured said tab 5 by means of a fixture 8, for example, a rivet or the like.

At one side of said tab 5 is provided a semi-circular portion 10 overlapping with the other side of said opening-lid 6, while on the other side of said tab 5 is provided a ring-like knob 9. In the center of said tab 5 is formed a cutting piece 11 of a ltter "U" configuration, to which is mounted said fixture 8. Accordingly, said ring-like knob 9 being picked up, said semi-circular portion 10 will be lowered to press said opening-lid 6, thus said groove 7 will be cut off so that said opening-lid 6 is pushed within the container 1 to make an aperture 6A in the container lid 3. At the same time, a protruding piece 29 is pressed downward by the above-mentioned action, which restores its innitial position owing to the elastic force thereof after the insertion of said semi-circular portion 10 into said aperture 6A.

An auxiliary lid body 21 is formed of approximately a rectangular tabular member made of thin aluminum, steel or synthetic resin material. And at one edge side of an upper surface 22 thereof covering a distance A off over said opening-lid 6 is formed a circular arc portion 23, while a plurality of air holes 24,24A are provided on the surface. The air holes 24 are positioned in the center of said auxiliary lid body 21, while the air holes 24A are biased toward the peripheral edge thereof. Further, at one and both sides of said upper surface 22 are formed one-side wall 25 and both-sides wall 26 extending downward.

Approximately the center of said upper surface 22 is bent downward by cutting the same toward the center, of which the cut part 27 forms an other-side wall 28 extending downward. Furthermore, at the lower side of said other side-wall 28 is provided a protruding piece 29 bent horizontally, of which the tip is cut of a circular arc configuration communicating with said other-side wall 28, so that said protruding portion 29 is inserted between said lid 3 and said semi-circular portion 10 in order to secure said auxiliary lid body 21. Reference numeral 30 designates an other-side wall provided on the both sides of said auxiliary lid body 21 adjacent said tab 5.

Hereinafter is explained the action of the said structure of the present invention.

The auxiliary lid body 21 is placed on the lid 3 of the container 1 so that said protruding piece 29 may be inserted between said lid 3 and said semi-circular portion 10, whereas the upper surface 22 of said auxiliary lid body 21 spacedly extends over said opening-lid 6. The protruding portion 29 is, in this state, temporarily fixed by said tab 5, while said circular arc portion 23 is temporarily anchored by the errected edge 4 of the container 1.

When the ring-like knob 9 is picked up to open said opening-lid 6, one side of said tab 5 will press said opening-lid 6 so that said groove 7 will crack to cut off said opening-lid 6. Consequently, said opening-lid 6 will be pressed inside the container 1, in which case, the bubbles and liquid (not shown) contained in said container 1 will spout out from said aperture 6A, which will stop and remain within a space surrounded by said auxiliary lid body 21 and said lid 3, while only the gas contained therein will be discharged through said air holes 24, 24A. Thereafter, said auxiliary lid body 21 is removed from said lid 3 to drink beer, soda pop or the like through said aperture 6A.

With the structure thus made, one can safely drink beer, soda pop or the like in picking up the tab 5 because the bubbles and liquid contained in the container 1 can be prevented from dispersing in all the directions by means of said auxiliary lid body 21, with the gas contained therein being discharged through air holes provided therein.

Furthermore, said auxiliary lid body 21 will be free from unsteadiness or backlash in opening the container 1 because said protruding piece 29 is inserted between said lid 3 of the container 1 and said tab 5 so as to temporarily secure the auxiliary lid body 21 thereto.

In FIGS. 8 to 12 showing a second embodiment of the present invention, the same portions as those of the foregoing first embodiment are designated as the common reference numerals, and their repeated detail descriptions will be omitted.

In accordance with the second embodiment, a protruding piece 31 which communicates with the auxiliary lid body 21 to anchor the same is placed on both the semi-circular portion 10 and the cutting piece 11, extending to reach the fixture 8 of said tab 5, which penetrates through the tip of said protruding piece 31, whereby said protruding piece 31 is integrated with said lid 3 and said fixture 8.

Here, the reference numeral 32 designates a hole which is formed in the end of said protruding piece 31 in order that said fixture 8 may penetrate therethrough.

With said auxiliary lid body 21 placed on the container 1 in advance, said knob 9 of the tab 5 is picked up so that said opening-lid 6 is pressed into the container 1 to be opened, in which case, the bubbles and liquid of beer, soda pop or the like (not shown) contained in the container 1 will spout out from the aperture 6A, which will stop within a space surrounded by said auxiliary lid body 21 and said lid 3, whereas only the gas contained therein will be discharged through the air holes 24, 24A.

Thereafter, said auxiliary lid body 21 is to be picked up and, where necessary, be torn off from the protruding piece 31 along the cut line (not shown) provided thereon. Alternatively, said auxiliary lid body 21 may be bent upwards together with said protruding piece 31 so that said aperture 6A may appear, thereby beer, soda pop or the like can be drunk therethrough.

Figure 13:
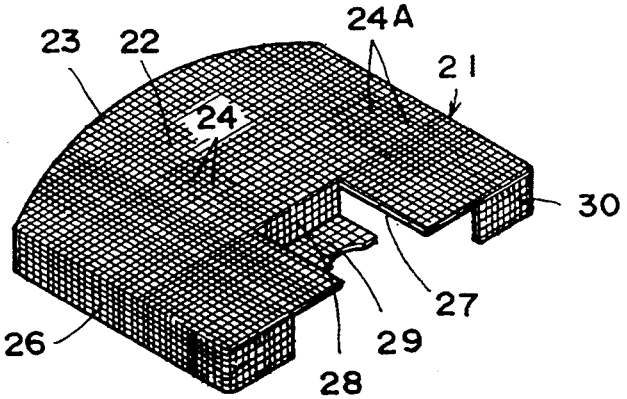
FIG. 13 is a perspective view showing an auxiliary lid of the third embodiment of the present invention.

Incidentally, the present invention should not be limited to the embodiments thus far described but can be modified in various manners. For example, as shown in FIG.13, said auxiliary lid body may be formed of fine mesh-like material which is braided with linear material.

What is claimed:

1. A container for a liquid with an auxiliary lid to resist spouting of the liquid, comprising:
   a container body having a lid surface at an end, said lid surface having an aperture to permit release of the liquid from the container body, said lid surface including an opening-lid portion to removably close said aperture; and
   an auxiliary lid mounted on said lid surface substantially surrounding said aperture, said auxiliary lid having a plurality of vent holes sufficiently small to resist passage of liquids while permitting venting of gases from said aperture when opened.

2. A container with auxiliary lid as set forth in claim 1, wherein said auxiliary lid includes an upper surface located a distance above said lid surface and a side surface projecting from said upper surface to said lid surface and effectively enclosing, with said upper surface, said aperture, said plurality of vent holes being formed in said upper surface.

3. A container for a liquid with an auxiliary lid to resist spouting of the liquid, comprising:
   a container body having a lid surface at an end, said lid surface having an aperture to permit release of the liquid from the container body, said lid surface including an opening-lid portion to removably close said aperture;
   an auxiliary lid mounted on said lid surface substantially surrounding said aperture; and
   means for at least partially removing said opening-lid portion to open said aperture under said auxiliary lid.

4. The container with auxiliary lid as set forth in claim 3, wherein the removing means is a tab pivotally secured to said lid surface, said tab being pivotable to engage the opening-lid portion to open said aperture.

5. The container with auxiliary lid as set forth in claim 3, wherein said auxiliary lid is removable.

6. The container with auxiliary lid as set forth in claim 3, wherein said auxiliary lid is secured to said lid surface and is movable to expose said aperture.

7. A method for opening a closed aperture of a container of liquid and retarding the spouting of the liquid from the aperture, said method comprising the steps of:
   mounting an auxiliary lid having vent holes on the container so as to substantially cover the closed aperture;
   opening said closed aperture; and
   capturing spouting liquid within said auxiliary lid while allowing passage of gases through said vent holes.

8. A container and an auxiliary lid, comprising:
   a container body having a lid;
   an opening-lid formed on said lid of the container with an annular groove around its periphery;

a knob secured to said lid by a rivet; said knob being positioned to press the opening-lid into the container by cutting said groove when a portion of said knob is lifted away from said lid; and an auxiliary lid including an upper surface having a plurality of small air holes, covering a distance over said opening-lid; a partial side wall and lateral side walls extending from said upper surface toward said lid; a protruding piece (29) provided at a lower edge of said partial side wall and extending parallel to said upper surface, a tip of which being cut of a circular arc configuration, communicating with said partial side wall, so that said protruding piece (29) is inserted between said lid and a semi-circular portion of said knob to secure said auxiliary lid to said container lid.

9. A container and an auxiliary lid according to claim 8, wherein said air holes are formed by braiding with fine mesh-like material.

10. A container and an auxiliary lid according to claim 8, wherein said protruding piece is provided with a cut line at the tip thereof.

11. A container and an auxiliary lid according to claims 8, wherein said upper surface of said auxiliary lid is formed lower than an erected edge (4) of said lid.

12. A container and an auxiliary lid according to claims 8, wherein said lateral side walls are located nearer said rivet than said partial side wall communicating with the protruding piece.

13. A container and an auxiliary lid according to claims 8, wherein there is a clearance between said partial side wall and lateral side walls.

14. A container and an auxiliary lid, comprising:

a container body having a lid;

an opening-lid formed on said lid of the container with an annular groove around its periphery;

a knob secured to said lid by a rivet; said knob being positioned to press the opening-lid into the container by cutting said groove when a portion of said knob is lifted away from said lid; and an auxiliary lid including an upper surface having a plurality of small air holes, covering a distance over said opening-lid; a partial side wall and lateral side walls extending from said upper surface toward said lid; a protruding piece (31) provided at a lower edge of said partial aide wall and extending parallel to said upper surface, said protruding piece (31) being secured by penetration of said rivet through said protruding piece (31) said lid and a semi-circular portion of said knob.

15. A container and an auxiliary lid according to claim 14, wherein said air holes are formed by braiding with fine mesh-like material.

16. A container and an auxiliary lid according to claims 14, wherein said upper surface of said auxiliary lid is formed lower than an erected edge (4) of said lid.

17. A container and an auxiliary lid according to claim 14, wherein said lateral side walls are located nearer said rivet than said partial side wall communicating with the protruding piece.

18. A container and an auxiliary lid according to claims 14, wherein there is a clearance between said partial side wall and lateral side walls.

* * * * *